US008112899B1

(12) United States Patent
Duckworth

(10) Patent No.: US 8,112,899 B1
(45) Date of Patent: Feb. 14, 2012

(54) WALL-MOUNTED BODY BLOW DRYER

(76) Inventor: Russell L. Duckworth, Cumberland, MD (US)

( * ) Notice: Subject to any disclaimer, the term of this patent is extended or adjusted under 35 U.S.C. 154(b) by 106 days.

(21) Appl. No.: 12/381,169

(22) Filed: Mar. 9, 2009

Related U.S. Application Data

(60) Provisional application No. 61/068,310, filed on Mar. 7, 2008.

(51) Int. Cl.
*F26B 3/00* (2006.01)
*F26B 19/00* (2006.01)

(52) U.S. Cl. ..... 34/202; 34/218; 34/233; 34/526; 34/546; 34/554; 34/562; 34/88; 34/89; 34/90

(58) Field of Classification Search ..... 34/201, 34/202, 218, 232, 233, 235, 90, 526, 543, 34/546, 549, 554, 562, 88, 89; 392/379, 392/380, 381; 4/598, 599, 607
See application file for complete search history.

(56) References Cited

U.S. PATENT DOCUMENTS 4,352,248 A * 10/1982 Kobayashi ..... 34/88
4,961,272 A * 10/1990 Lee ..... 34/90
5,024,015 A * 6/1991 Quarles, Jr. ..... 40/605
5,099,587 A * 3/1992 Jarosch ..... 34/202
5,103,577 A 4/1992 Michaels et al.
5,269,071 A 12/1993 Hamabe et al.
5,421,112 A * 6/1995 Knorr ..... 40/600
D372,339 S 7/1996 Coykendall et al.
D382,950 S 8/1997 Kruger
6,130,991 A * 10/2000 Chapman ..... 392/367
6,148,539 A 11/2000 Hatfield et al.
6,349,484 B1 2/2002 Cohen
6,718,650 B2 4/2004 Ross
6,962,005 B1 11/2005 Khosropour et al.

* cited by examiner

*Primary Examiner* — Jiping Lu
(74) *Attorney, Agent, or Firm* — Montgomery Patent & Design, LLC; Robert C. Montgomery; Joseph T. Yaksich

(57) ABSTRACT

A wall-mounted, hot air body blow drying apparatus comprising a plurality of round nozzles located along a front surface of the apparatus is herein disclosed. Said nozzles are adjustable and capable of directing jets of warm air over a person's body. A flow of heated air is provided by a resistance heater, an electric blower, and a plurality of distributing ductwork. The apparatus may be hard-wired thereto a standard household power circuit or by using a standard power cord. The apparatus is variably controlled by a temperature and fan speed controlling system and a timer. To use, a person would stand in front of the dryer apparatus and slowly turn around, allowing the multiple heated forced air streams to dry their body in a similar fashion as a forced warm air hand dryer.

10 Claims, 7 Drawing Sheets

WALL-MOUNTED BODY BLOW DRYER

RELATED APPLICATIONS

The present invention was first described in and claims the benefit of U.S. Provisional Application No. 61/068,310 filed on Mar. 7, 2008, the entire disclosures of which are incorporated herein by reference.

FIELD OF THE INVENTION

The present invention relates generally to a heated air blow dryer and, more particularly, to a heated air wall-mounted body blow dryer.

BACKGROUND OF THE INVENTION

After bathing, one commonly uses one or more towels to dry their hair and body. These towels must be washed and dried, so as to keep fresh smelling, avoid mildew, and avoid piling up of dirty towels. Regularly washing and drying dirty towels consumes water, detergent, energy, and time. The price of energy and water has had an upward trend for decades and as people become more and more environmentally conscious, conservation of our natural resources has moved to the forefront of public awareness.

Heaters and blowers exist for area warming, hair drying, and hand drying although, these devices are commonly too large, too small, or too inefficient to adequately dry off a wet body after a bath, shower, being caught in the rain, or other water related activity. General heating devices are simply intended to warm a body or area and the drying effect is ancillary. Blow drying devices typically focus the force of the drying warm air stream to a particular part of the body and are cumbersome if used on larger areas. These devices have historically been used in industrial settings, public service areas, or the like and often require permanent installation methods, a large amount of space for set up and operation, and a high electrical power usage. Additionally, these types of devices have not been readily available or viable for an average consumer to obtain and utilize in a residential setting.

Various attempts have been made in the past to overcome these disadvantages and provide a means of drying a user's body. Among the relevant attempts to address these problems are several U.S. patents, including U.S. Pat. Nos. 5,269,071; 6,148,539; and, 6,962,005.

U.S. Pat. No. 5,103,577, issued in the name of Michaels et al., describes a body heater and dryer comprising a free standing tubular base unit having a plurality of air output openings of varying size and shape and a common type heating element and blower as used in a hand held hair dryer which provides a means of dispersing warm air to many areas of a user.

U.S. Pat. No. 6,349,484, issued in the name of Cohen, describes a body dryer comprising an elongated housing with a front mounted mirror and a plurality of internal heating coils. Air is heated within the internal periphery of the housing and a plurality of blowers is mounted to the front face of the housing blows out the internally heated air.

U.S. Pat. No. 6,718,650, issued in the name of Ross, describes a personal dryer comprising a cabinet style housing having an internal air conditioning apparatus which provides a means of expelling temperatured air uniformly or regionally through a front drying assembly.

Additionally, ornamental designs for hand held cutting and stripping tools exist, particularly, U.S. Pat. Nos. D 372,339 and D 382,950. However, none of these designs are similar to the present invention.

While these devices fulfill their respective, particular objectives, each of these references suffers from one or more of the aforementioned disadvantages. Accordingly, there exists a need for a means by which drying after a bath or shower can be accomplished without the disadvantages as described above. The development of the present invention herein described substantially departs from the conventional disadvantages and fulfills this need.

SUMMARY OF THE INVENTION

In view of the foregoing references, the inventor recognized the aforementioned inherent problems and observed that there is a need for a full body blow dryer with a means of wall mounting and thus, the object of the present invention is to solve the aforementioned disadvantages.

To achieve the above objective, it is the object of the present invention to provide a wall-mounted body blow drying apparatus which provides a means for directing jets of heated air over a person's body for drying after a bath or a shower. The apparatus operates in a similar manner as a forced warm air hand dryer and comprises a plurality of circular air flow nozzles located along a front surface.

Another object of the present invention is to provide an apparatus comprising a center section, a left section, a right section, a plurality of internal ductwork, a plurality of nozzles, a blower, a heating element, a plenum, a blower speed and power dial, a temperature control dial, a display, a timer dial, a power cable, and a plug.

Yet still another object of the present invention is to provide an apparatus comprising the left and right sections which are hingedly connected to the center section in such a manner as to enable the apparatus to deploy to a planar or partially planar state during use and fold to a compact and storable state when not in use.

Yet still another object of the present invention is to provide a plurality of blower outputs on a front surface of the sections comprising individually adjustable air flow nozzles which provide a means of specifically directing forced heated air over a user's body. The nozzles are adjustable in an orbital manner and connect to the internal ductwork which supplies the heated air from the plenum.

Yet still another object of the present invention is to provide a resistance heater, an electric blower, and a plurality of internal distributing ductwork which provides a means of producing and dispersing an amount of forced heated air. Air directed from the blower is heated within the plenum and is supplied to the nozzles as channeled through the ductwork.

Yet still another object of the present invention is to provide convenient controls including a temperature control dial, a blower speed dial, a settable timer, and a digital display which provide a means to variably control the temperature of the heated output air, the blower fan speed, and the timer.

Yet still another object of the present invention is to provide a means of mounting the apparatus to a wall or similar planer surface comprising a plurality of mounting apertures on a back side of the center, left, and right sections.

Yet still another object of the present invention is to provide a means of enabling the apparatus to be self standing comprising a plurality of leg units which removable connect to an underside of the center section and allow for use of the invention when a planer mounting surface is unavailable.

Yet still another object of the present invention is to provide a method of powering the apparatus comprising a hard-wired connection to a standard household power circuit or by using a standard power cord.

Yet still another object of the present invention is to provide a method of utilization of the wall-mounted body blow drying apparatus in which a person would stand in front of the dryer apparatus and slowly turn around, allowing the multiple heated forced air streams to dry their body in a similar fashion as a forced warm air hand dryer.

Further objects and advantages of the present invention will become apparent from a consideration of the drawings and ensuing description.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
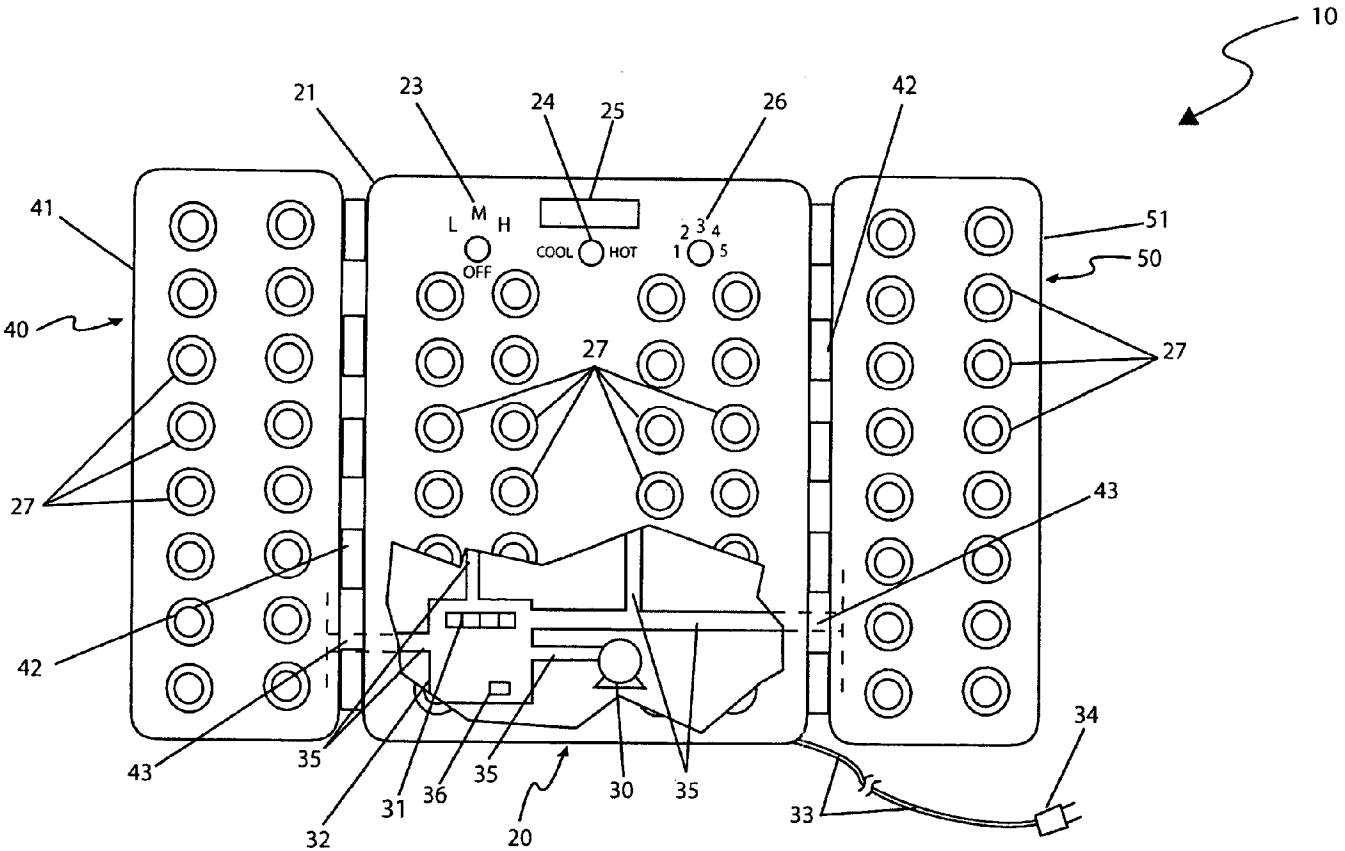
FIG. 1 is a front view of a wall-mounted body blow dryer 10, in an open position according to a preferred embodiment of the present invention.

10 wall-mounted body blow dryer
20 center section
21 center section housing
22 control module
23 power/blower speed dial
24 temperature control dial
25 display
26 timer dial
27 nozzle
28 spherical member
29 socket
30 blower
31 heating element
32 plenum
33 power cable
34 plug
35 ductwork
36 temperature sensor
40 left section
41 left section housing
42 hinge
43 air aperture
50 right section
51 right section housing
60 mounting aperture
70 leg unit
72 leg post
74 leg aperture
80 heated air
90 floor surface

DETAILED DESCRIPTION OF THE PREFERRED EMBODIMENT

Figure 3:
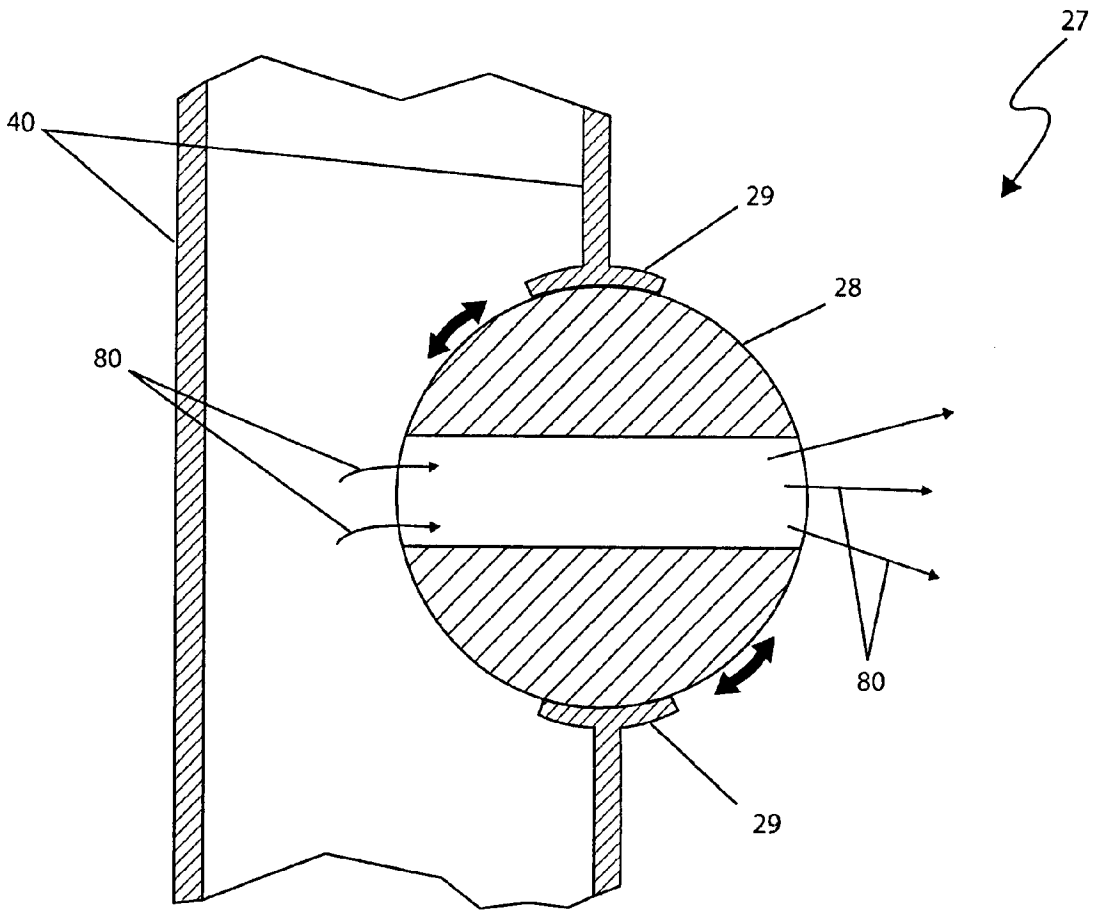
FIG. 3 is a close-up view of a nozzle portion 27 of the wall-mounted body blow dryer 10, according to a preferred embodiment of the present invention.
Figure 4:
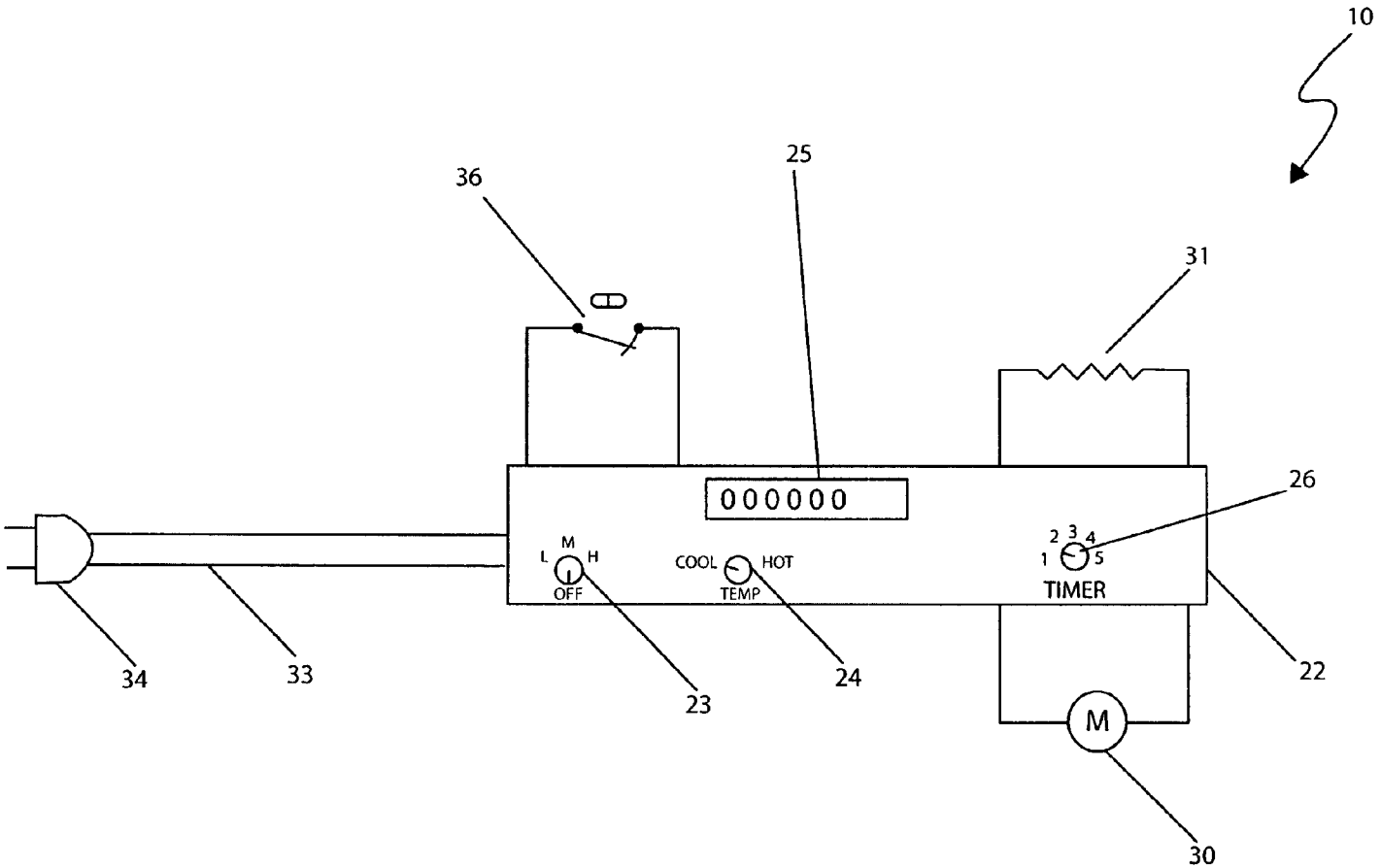
FIG. 4 is an electrical block diagram of a wall-mounted body blow dryer 10, according to a preferred embodiment of the present invention.
Figure 5A:
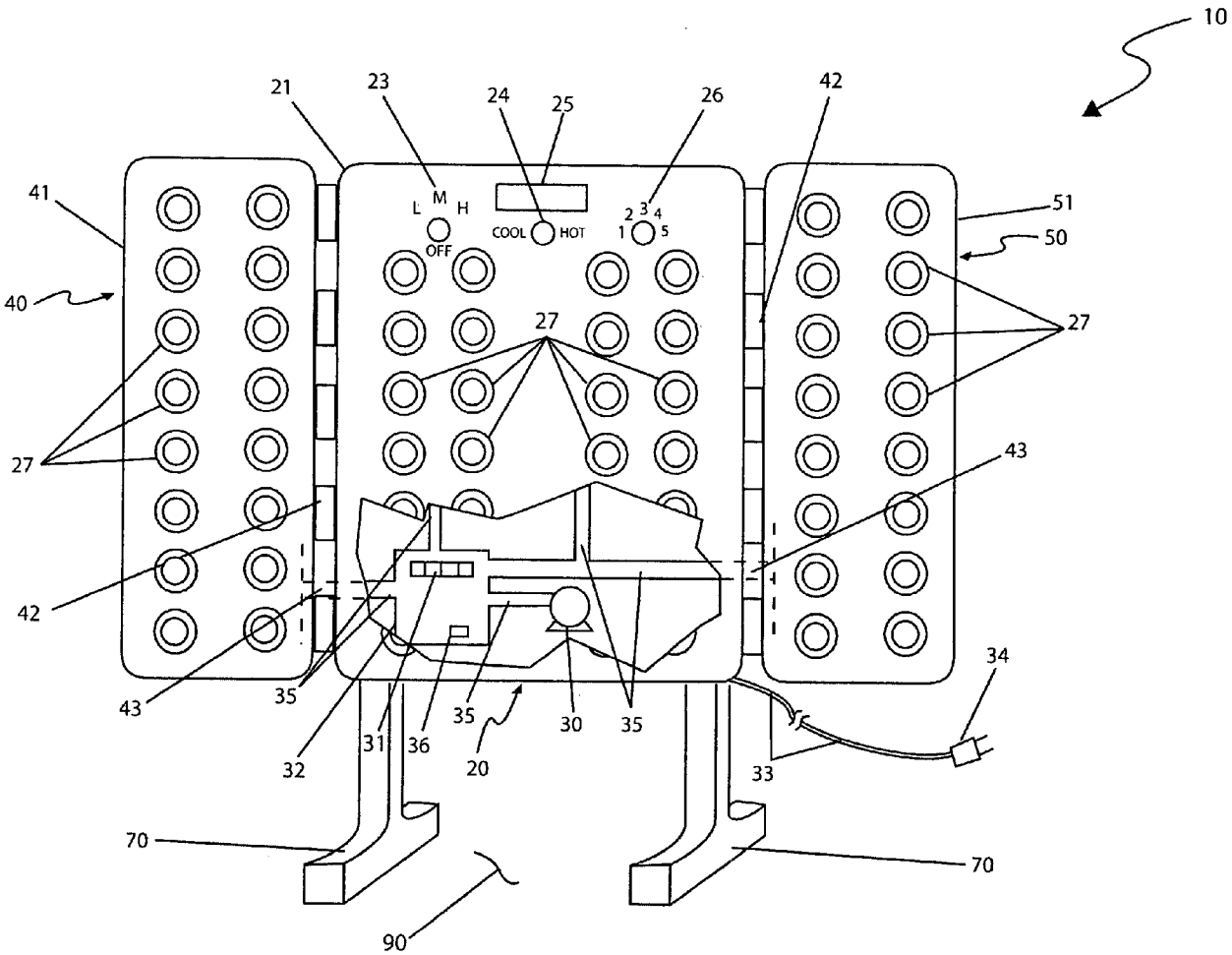
FIG. 5*a* is a front view of a wall-mounted body blow dryer 10 depicting an alternate floor standing configuration, according to an alternate embodiment of the present invention; and, FIG. 5*b* is an upward-looking view of a wall-mounted body blow dryer 10 depicting an alternate floor standing configuration, according to an alternate embodiment of the present invention.
Figure 5B:
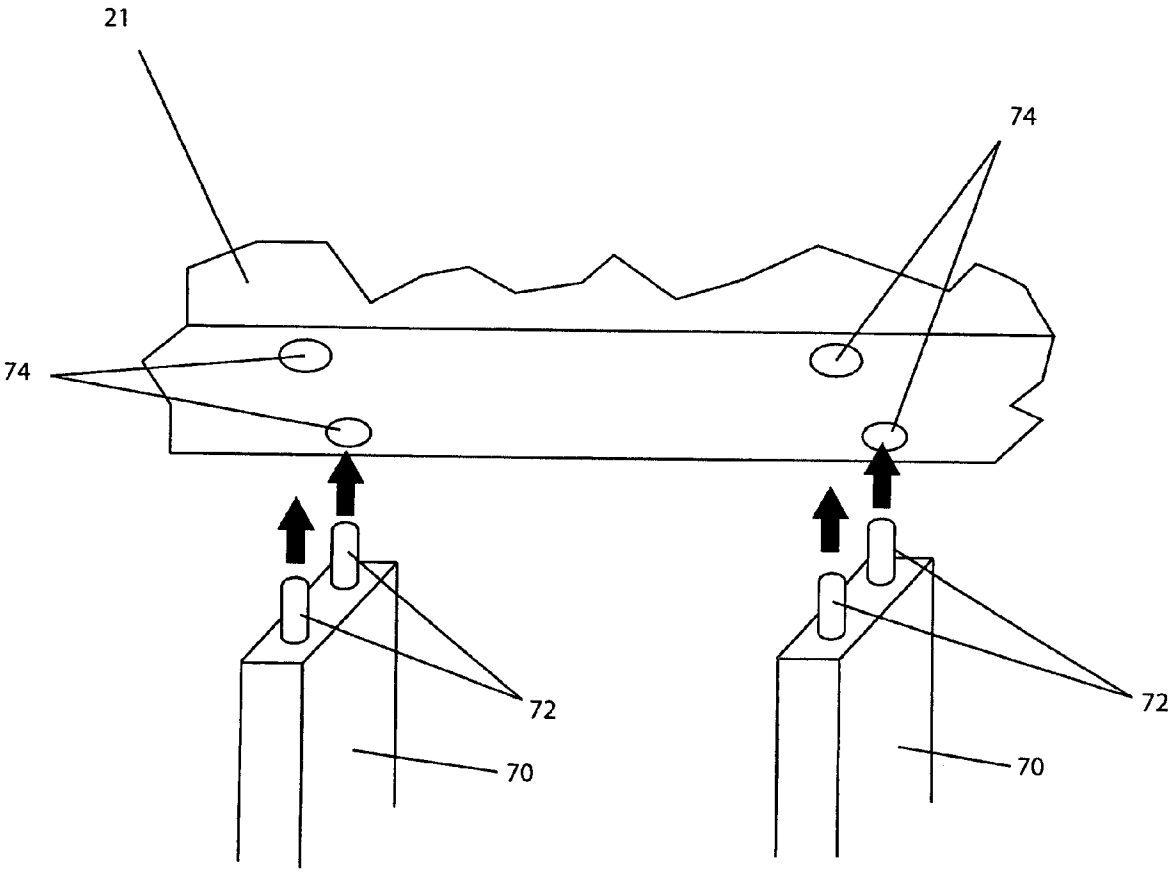

The best mode for carrying out the invention is presented in terms of its preferred embodiment, herein depicted within FIGS. 1 through 4, and presented in terms of an alternate floor standing embodiment, herein depicted in FIGS. 5*a*-5*b*. However, the invention is not limited to the described embodiment and a person skilled in the art will appreciate that many other embodiments of the invention are possible without deviating from the basic concept of the invention, and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

The present invention describes a wall-mounted body blow dryer (herein described as the "apparatus") 10, which provides a means for directing jets of heated warm air 80 over a person's body to dry oneself after a bath or shower. The apparatus 10 operates in a similar manner as a forced warm air hand dryer and comprises a plurality of circular air flow nozzles 27 located along a front surface. Said nozzles 27 are orbitally adjustable and capable of specifically directing said heated air 80 over a person's body. Said heated air 80 is supplied by a resistance heater 31 and an electric blower 30. The apparatus 10 comprises convenient controls including a temperature control dial 24, a power/blower speed dial 23, a settable timer 26, and a digital display 25. To use, a person would stand in front of the apparatus 10 and slowly turn around, thereby allowing the multiple heated forced air streams 80 to dry their body.

Referring now to FIG. 1, a front view of the apparatus 10 in an open state, according to the preferred embodiment of the present invention, is disclosed. The apparatus 10 comprises a center section 20, a center section housing 21, a power/blower speed dial 23, a temperature control dial 24, a display 25, a timer dial 26, a plurality of nozzles 27, a blower 30, a heating element 31, a plenum 32, a power cable 33, a plug 34, a plurality of internal ductwork 35, a left section 40, a left section housing 41, a plurality of hinges 42, a right section 50, and a right section housing 51. When fully deployed thereto a coplanar state, said center section 20, left section 40, and right section 50 form a panel approximately two (2) to three (3) feet wide and approximately three (3) feet high.

The air flow nozzles 27 are individually adjustable in an orbital manner allowing directing of heated air 80 in a custom fashion (see FIG. 3). A flow of air is produced via the blower 30 which comprises a commercially available miniature fan or squirrel-cage type air communicating unit with an integral motor portion further comprising a tubular air outlet conduit which provides a tubular attachment means thereto the plenum 32. Said air therefrom the blower 30 is heated therewithin the plenum 32 which comprises a sealed plastic or metal rectangular vessel comprising an internal volume of air sufficient to supply the apparatus 10. The plenum 32 further comprises a heating element 31 to heat the incoming air to produce a flow of heated air 80 and a temperature sensor 36 to control an output temperature thereof. The temperature sensor 36 provides a controlling and safety means via a conducted signal thereto a control module 22 (see FIG. 4). The plenum 32 provides a distribution means thereto the heated air 80 via a tubular attachment thereto a plurality of tubular ductwork members 35 affixed thereto and extending therefrom external surfaces of said plenum 32. The ductwork 35 is made of molded plastic or metal tubing sections made using appropriately temperature-rated materials, so as to provide a conduit means thereto the heated air 80 being subsequently propelled thereto the center 20, left 40, and right 50 sections of the apparatus 10. The center section 20 provides a vertical linear rotating attachment thereto said left 40 and right 50 sections via respective hinges 42. The hinges 42 comprise stacked alternating and pivoting axial elements. Each hinge 42 also provides one (1) or more heated air apertures 43 which comprise integral round or rectangular openings, thereby allowing a flow of heated air 80 therefrom the previously described ductwork 35 to pass therethrough said hinges 42 thereinto the left 40 and right 50 sections. Although a single blower 30, single heating element 31, and a single plenum 32 are depicted here, it is understood that there may be multiple blowers 30, heating elements 31, and plenums 32 arranged therewithin the apparatus 10 based upon particular temperature and air volume requirements and as such, should not be interpreted as a limiting factor of the apparatus 10.

The center section housing 21, left section housing 41, right section housing 51, air flow nozzles 27, and the hinges 42, are all envisioned to be made using molded temperature-rated plastic portions made using materials such as, but not limited to: acrylonitrile butadiene styrene (ABS) or polypropylene.

The apparatus 10 provides a plurality of operational user controls comprising a power/blower speed dial 23, a temperature control dial 24, a settable timer 26, and a digital display 25. The power/blower speed dial 23, temperature control dial 24, and timer dial 26 comprise common panel-mount rotary electronic selector switches located thereacross an upper forward facing portion of the center section 20. The power/blower speed dial 23 provides a dual-function comprising an ON/OFF setting as well as a plurality of blower speed settings such as, for example, "L"-low, "M"-medium, and "H"-high. In like manner, the temperature control dial 24 provides a plurality of temperature settings such as, for example, "COOL" and "HOT". In like manner, the timer dial 26 provides selection of incremental time intervals expressed in minutes such as, for example, "1", "2", and "3". In use, the timer dial 26 is set thereat a desired amount of drying time according to a user's preference and automatically shutting off the apparatus 10 after a set period of time has expired. The power/blower speed dial 23, temperature control dial 24, timer dial 26, and display 25, are preferably combined thereinto a single electronic unit mounted thereto, and in mechanical communication therewith, a control module 22 located therebehind a front surface portion of the center section housing 21, thereby providing a protective sealed enclosure thereto said controls 23, 24, 25, 26 and corresponding electrical and electronic components therewithin, being necessary for operation of the apparatus 10 (see FIG. 4).

Also located thereacross an upper forward facing portion of the center section 20 is the display 25. The display 25 comprises a common light-emitting diode (LED) or liquid crystal diode (LCD) display panel providing one (1) or more illuminated lines of information such as, but not limited to: current running status, selected control parameters, remaining drying time, and the like.

Figure 2A:
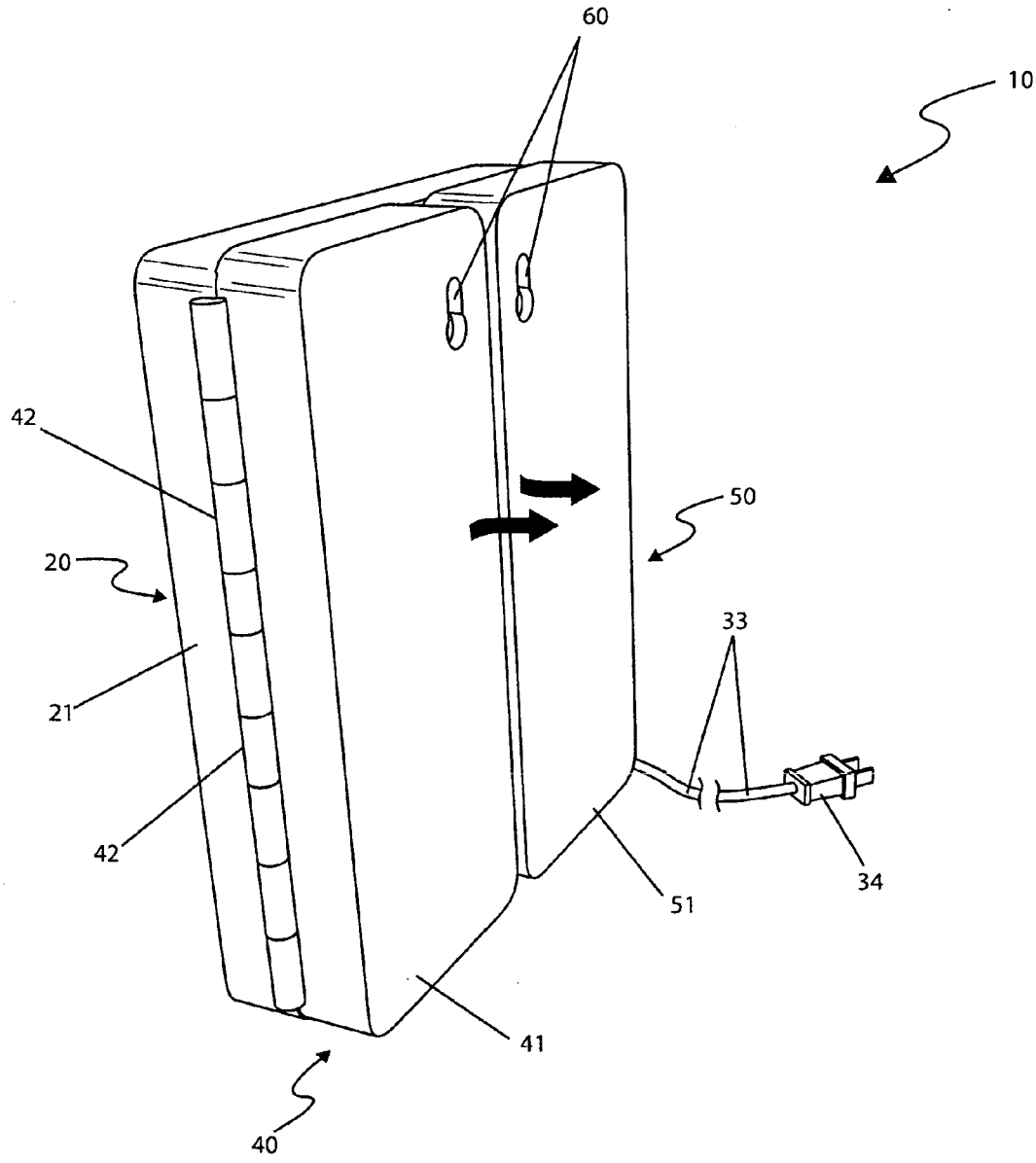
FIG. 2*a* is a front perspective view of a wall-mounted body blow dryer 10 in a closed state, according to a preferred embodiment of the present invention.
Figure 2B:
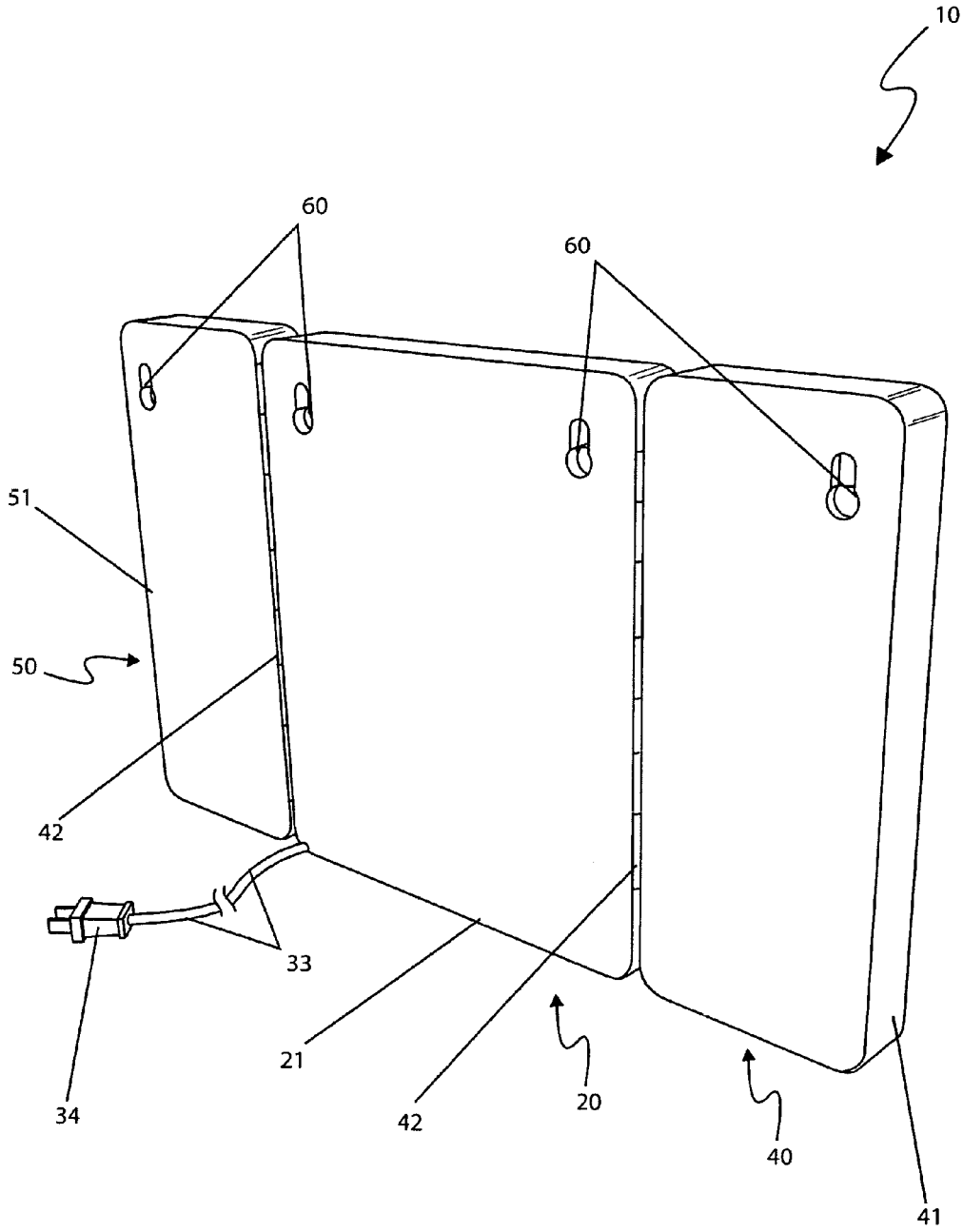
FIG. 2*b* is a rear perspective view of a wall-mounted body blow dryer 10 in an open state, according to a preferred embodiment of the present invention.

Referring now to FIGS. 2*a* and 2*b*, front and rear perspective views, respectively, of the apparatus 10, according to the preferred embodiment of the present invention, is disclosed. The left section 40 and the right section 50 comprise a particular width being approximately one-half (½) the width of the center section 20 so as to fold inwardly thereupon said center section 20 forming a compact storage means as shown in FIG. 2*a*. During use, said left 40 and right 50 sections may be pivoted therearound the hinges 42, thereby being angularly adjustable anywhere from a fully open position to a fully closed position based upon a user's preference. Said center 20, left 40, and right 50 sections each comprise two (2) or more molded-in keyhole-shaped mounting apertures 60 along respective rear surfaces, thereby providing convenient hanging attachment thereto a wall structure using common fasteners such as screws, nails, or the like. It is further understood that the apparatus 10 may be mounted thereto a wall using various means including methods such as, but not limited to: mating pairs of mounting brackets, multiple hook fixtures, various types of fasteners.

Referring now to FIG. 3, a close-up cut-away view of a nozzle portion 27 of the apparatus 10, according to a preferred embodiment of the present invention, is disclosed. The air flow nozzles 27 comprise spherical members 28 which are rotatably mounted therewithin forward facing sockets 29 being integrally-molded therein front surfaces of the center 21, left 41, and right 51 section housing portions. Each nozzle 27 is individually manually adjustable in an orbital manner allowing a user to direct each nozzle 27 and corresponding jet of propelled heated air 80 in a custom direction.

Referring now to FIG. 4, an electrical block diagram of the apparatus 10, according to the preferred embodiment of the present invention, is disclosed. The apparatus 10 comprises a power/blower speed dial 23, a temperature control dial 24, a timer dial 26, a display 25, a blower 30, a heating element 31, a power cable 33, a plug 34, and a temperature sensor 36. Electrical power is supplied thereto the apparatus 10 via a standard 110-volt power cable 33 and plug 34; however, it is understood that the apparatus 10 may be provided in both 110-volt and 220-volt models with corresponding plug fixtures 34, thereby providing multi-voltage installations as well as European applications. Further, it is understood that the apparatus 10 may also be hard-wired directly into an existing home wiring system within a wall or similar structure without deviating from the concept and as such should not be interpreted as a limiting factor of the apparatus 10. Said supply current is provided thereto the control module 22 which comprises a microprocessor-based operating system further comprising internal electrical and electronic components such as, but not limited to: one (1) or more microprocessors, one (1) or more printed circuit boards, embedded software, relays, and the like. The control module 22 receives conducted input signals therefrom the aforementioned power/blower speed dial 23, temperature control dial 24, and timer dial 26, thereby configuring a subsequent drying cycle of the apparatus 10 based upon user preferred settings. Initiating of said drying cycle begins once the power/blower speed dial 23 is moved therefrom the "OFF" position thereto a particular blower speed as indicated thereupon the power/blower speed dial 23. When the drying cycle is activated, the control module 22 provides various operational information thereto the display 25 as well as supplying an output current thereto the heating element 31 and the motor portion of the blower 30 per user selected parameters. The operation of the apparatus 10 continues until the amount of time selected thereupon the timer dial 26 expires. The temperature sensor 36 comprises a common thermocouple-type device which provides a continuous input analog signal thereto the control module 22, thereby providing control of power thereto the heating element 31 resulting in a particular temperature of the heated air 80 therewithin the apparatus 10. The temperature sensor 36 may also curtail the drying cycle for safety purposes in such an event as the heated air 80 therewithin the plenum 32 becomes excessively hot, thereby causing the control module 22 to cease output currents thereto the heating element 31 and blower 30.

Referring now to FIGS. 5*a* and 5*b*, front and upward-looking views of the apparatus 10 depicting an alternate floor standing configuration, according to an alternate embodiment of the present invention, is disclosed. The apparatus 10 is illustrated here being configured with a pair of leg units 70 comprising stabilizing "T"-shaped appendages extending downwardly and outwardly therefrom the center section housing 21 along a floor surface 90, thereby allowing the apparatus 10 to be alternately placed upon said floor surface 90 in a secure manner. The leg units 70 comprise a pair of removably attachable fixtures providing attachment thereto the apparatus 10 via engagement of four (4) cylindrical leg posts 72 and four (4) corresponding leg apertures 74. The leg posts 72 and leg apertures 74 comprise integral injection-molded features of the leg units 70 and center section housing 21, respectively. The leg units 70 are envisioned being made using similar materials as the center section housing 21.

It is envisioned that other styles and configurations of the present invention can be easily incorporated into the teachings of the present invention, and only one particular configuration shall be shown and described for purposes of clarity and disclosure and not by way of limitation of scope.

The preferred embodiment of the present invention can be utilized by the common user in a simple and effortless manner with little or no training. After initial purchase or acquisition of the apparatus 10, it would be installed as indicated in FIG. 1, or alternately as depicted in FIG. 5.

The method of installing and utilizing the preferred embodiment of the apparatus 10 may be achieved by performing the following steps: mounting the apparatus 10 on a wall surface in proximity thereto a bathtub or shower using the mounting apertures 60 and appropriate mounting hardware; connecting the plug 34 thereto an electrical outlet or hard-wiring the apparatus 10 thereto an electrical circuit in accordance therewith applicable federal, state, and local codes; taking a shower or a bath in a normal manner; positioning oneself in front of the apparatus 10; pivoting and opening the left section 40 thereto a desired angle or flat to a wall surface; opening the right section 50 thereto a desired angle in like manner; selecting a desired air temperature using the temperature control dial 24; selecting a desired period of time using the timer dial 26; turning the power/blower speed dial 23 therefrom the "OFF" position thereto a desired blower speed, thereby setting a speed of the blower 30 and initiating the heating/drying cycle of the apparatus 10; adjusting the power/blower speed dial 23, temperature control dial 24, and timer dial 26 as desired to obtain desired drying results; adjusting a desired number of air flow nozzles 27 to direct a flow of heated air 80 thereto a portion, or portions of one's body; standing in front of the dryer and slowly turning to allow the multiple jets of heated air 80 to dry one's body in a similar fashion as a forced warm air hand dryer; resetting and/or shutting off the apparatus 10 by returning the power/blower speed dial 23 thereto the "OFF" position; repeating a drying cycle as described above as needed; turning off the apparatus 10 during a drying cycle, if desired, by rotating the power/blower speed dial 23 thereto the "OFF" position; and, compactly storing the apparatus 10 by closing the left 40 and right 50 sections thereagainst the center section 20 until the apparatus 10 is again needed.

The method of utilizing the alternate floor standing embodiment of the apparatus 10 may be achieved by performing the following additional steps: lifting and removing the apparatus 10 therefrom a wall surface by disconnecting the mounting apertures 60 therefrom said wall, if previously installed thereto; inserting the leg post portions 72 of the leg units 70 thereinto the corresponding leg aperture portions 74 of the center section housing 21; placing the apparatus 10 thereupon a floor surface 90; utilizing the apparatus 10 as previously described to dry one's body after a bath or shower.

The foregoing descriptions of specific embodiments of the present invention have been presented for purposes of illustration and description. They are not intended to be exhaustive or to limit the invention and method of use to the precise forms disclosed. Obviously many modifications and variations are possible in light of the above teaching. The embodiment was chosen and described in order to best explain the principles of the invention and its practical application, and to thereby enable others skilled in the art to best utilize the invention and various embodiments with various modifications as are suited to the particular use contemplated. It is understood that various omissions or substitutions of equivalents are contemplated as circumstance may suggest or render expedient, but is intended to cover the application or implementation without departing from the spirit or scope of the claims of the present invention.

What is claimed is:

1. A body blow dryer for directing heated warm air over a user body after taking a shower, said body blow dryer comprising:

a plurality of housing sections pivotally connected to each other;

a plurality of air flow nozzles located at each of said housing sections, each of said nozzles being orbitally adjustable along mutually exclusive rotational paths;

a blower situated within one (1) of said housing sections;

a plenum situated within said one (1) housing section and being operably coupled to said blower;

a heating element communicatively coupled to said plenum and being located downstream of said blower for heating air traveling through said plenum;

a plurality of tubular members in fluid communication with said plenum and said nozzles respectively, said tubular members extending between said housing sections and thereby distributing heated air to said nozzles respectively; and, a control module operably coupled to said blower and said heating element for permitting a user to program an operating mode of said body blow dryer;

wherein each of said housing sections comprises a plurality of hinges alternately stacked along corresponding sides thereof, each of said hinges being provided with an aperture for directing said tubular members between adjoining ones of said housing sections respectively;

wherein said housing sections comprise:

a center housing section; and, left and right housing sections pivotally coupled to opposed sides of said center housing section respectively;

wherein each of said left and right housing sections have a width equal to approximately one-half (½) a width of said center housing section such that said left and right housing sections are simultaneously and inwardly biased towards said center housing section; and, wherein said tubular members pass through said hinges respectively and remain disposed entirely within said hinges such that said tubular members are prohibited from being exposed exterior of said hinges as well as said center, left and right housings respectively.

2. The body blow dryer of claim 1, further comprising: a temperature sensor communicatively coupled to said plenum for detecting a temperature of the heated air traveling into said tubular members, said temperature sensor being communicatively coupled to said control module for adjusting the operating mode of said body blow dryer.

3. The body blow dryer of claim 1, further comprising: a plurality of operational user controls comprising:

a blower speed dial for adjusting said blower between a plurality of blower speed settings;

a temperature control dial for adjusting a temperature of said heating element;

a timer for setting a desired amount of drying time according to a user preference such that said blower and said heating element are automatically shut off after said drying time expires; and, a digital display for visually identifying an operating mode of said body blow dryer.

4. The body blow dryer of claim 1, wherein each of said center, left and right housing sections comprises: a plurality of mounting apertures formed along respective rear surfaces thereof for assisting a user to hang said body blow dryer on a support surface.

5. The body blow dryer of claim 1, further comprising: a plurality of "T"-shaped leg units extending downwardly and outwardly from said one housing section and thereby resting along a floor surface, each of said leg units comprising:

a leg post removably attached to said center housing section; and, a fixture removably attached to said leg post for engaging the floor surface.

6. A body blow dryer for directing heated warm air over a user body after taking a shower, said body blow dryer comprising:

a plurality of housing sections pivotally connected to each other;

a plurality of air flow nozzles located at each of said housing sections, each of said nozzles being orbitally adjustable along mutually exclusive rotational paths;

a blower situated within one (1) of said housing sections;

a plenum situated within said one (1) housing section and being operably coupled to said blower;

a heating element communicatively coupled to said plenum and being located downstream of said blower for heating air traveling through said plenum;

a plurality of tubular members in fluid communication with said plenum and said nozzles respectively, said tubular members extending between said housing sections and thereby distributing heated air to said nozzles respectively; and, a control module operably coupled to said blower and said heating element for permitting a user to program an operating mode of said body blow dryer;

wherein each of said nozzles is independently adjustable in an orbital manner;

wherein each of said housing sections comprises a plurality of hinges alternately stacked along corresponding sides thereof, said hinges being provided with an aperture for directing said tubular members between adjoining ones of said housing sections respectively wherein said housing sections comprise:

a center housing section; and, left and right housing sections pivotally coupled to opposed sides of said center housing section respectively;

wherein each of said left and right housing sections have a width equal to approximately one-half a width of said center housing section such that said left and right housing sections are simultaneously and inwardly biased towards said center housing section; and, wherein each said aperture is entirely contained within a corresponding one of said hinges respectively such that each said aperture remains entirely disposed inside said corresponding hinge and prohibited from being disposed exterior of said center, left and right housing sections.

7. The body blow dryer of claim 6, further comprising: a temperature sensor communicatively coupled to said plenum for detecting a temperature of the heated air traveling into said tubular members, said temperature sensor being communicatively coupled to said control module for adjusting the operating mode of said body blow dryer.

8. The body blow dryer of claim 6, further comprising: a plurality of operational user controls comprising:

a blower speed dial for adjusting said blower between a plurality of blower speed settings;

a temperature control dial for adjusting a temperature of said heating element;

a timer for setting a desired amount of drying time according to a user preference such that said blower and said heating element are automatically shut off after said drying time expires; and, a digital display for visually identifying an operating mode of said body blow dryer.

9. The body blow dryer of claim 6, wherein each of said center, left and right housing sections comprises: a plurality of mounting apertures formed along respective rear surfaces thereof for assisting a user to hang said body blow dryer on a support surface.

10. The body blow dryer of claim 6, further comprising: a plurality of "T"-shaped leg units extending downwardly and outwardly from said one housing section and thereby resting along a floor surface, each of said leg units comprising:

a leg post removably attached to said center housing section; and, a fixture removably attached to said leg post for engaging the floor surface.

* * * * *